United States Patent [19]

Miyazawa et al.

[11] 4,303,443

[45] Dec. 1, 1981

[54] ELECTROLESS COPPER PLATING SOLUTION

[75] Inventors: Osamu Miyazawa, Yokosuka; Hitoshi Oka, Yokohama; Isamu Tanaka, Yokosuka; Akira Matsuo; Hitoshi Yokono, both of Yokohama; Nobuo Nakagawa, Yokohama; Tokio Isogai, Fujisawa, all of Japan

[73] Assignee: Hitachi, Ltd., Tokyo, Japan

[21] Appl. No.: 159,231

[22] Filed: Jun. 13, 1980

[30] Foreign Application Priority Data

Jun. 15, 1979 [JP] Japan ..... 54-74615

[51] Int. Cl.[3] ..... C23C 3/02

[52] U.S. Cl. ..... 106/1.23; 106/1.26; 427/437; 427/443.1

[58] Field of Search ..... 106/1.23, 1.26; 427/437, 443.1

[56] References Cited

U.S. PATENT DOCUMENTS

| | | | |
|---|---|---|---|
| 3,310,430 | 3/1967 | Schneble et al. | 106/1.23 |
| 3,751,289 | 8/1973 | Arcilesi | 106/1.26 |
| 3,804,638 | 4/1974 | Jonker et al. | 106/1.26 |
| 3,843,373 | 10/1974 | Molenaar et al. | 106/1.26 |
| 4,002,786 | 1/1977 | Hirohata et al. | 106/1.26 |
| 4,099,974 | 7/1978 | Morishita et al. | 106/1.26 |
| 4,211,564 | 7/1980 | Oka | 106/1.23 |

*Primary Examiner*—Lorenzo B. Hayes

*Attorney, Agent, or Firm*—Craig and Antonelli

[57] ABSTRACT

When an amine compound having at least two polyolefin glycol chains in one molecule is used as a stabilizer, and an alkylene diamine compound, at least one hydrogen atom in the respective amino groups thereof being substituted by $CH_2COOX$ (wherein X is H or Na) and another hydrogen atom in the respective amino group thereof being substituted by $CH_2OH$, is used as a complexing agent for cupric ions and a nitrogen-containing cyclic compound is used as a complexing agent for cuprous ions in an electroless copper plating solution comprising water, a water-soluble copper salt, a complexing agent for cupric ions, a reducing agent, a pH-controlling agent and a stabilizer, or an electroless copper plating solution comprising water, a water-soluble copper salt, a complexing agent for cupric ions, a reducing agent, a pH-controlling agent, a stabilizer and a complexing agent for cuprous ions, the plating rate of the electroless copper plating solution, mechanical strength of plating film, and stability of the plating solution are improved.

11 Claims, No Drawings

ELECTROLESS COPPER PLATING SOLUTION

BACKGROUND OF THE INVENTION

1. Field of the Invention

This invention relates to an electroless copper plating solution for the production of printed boards, and more particularly to an electroless copper plating solution being free from autodecomposition and having a high deposition rate, with distinguished mechanical strength of product plating film.

2. Brief Description of the Prior Art

A copper plating solution with an autocatalytic action capable of continuously depositing copper electrolessly, that is, without using electricity, is technically well known. The copper plating solution usually comprises a water-soluble copper salt, a complexing agent for copper ions (single use of a complexing agent for cupric ions or simultaneous use of a complexing agent for cuprous ions and a complexing agent for cupric ions), a reducing agent for copper ions, and a pH-controlling agent, or further a stabilizer.

Well known, typical electroless copper plating solution includes an EDTA bath containing ethylenediamine tetraacetate (EDTA) as the complexing agent and a Rochelle salt bath containing Rochelle salt as the complexing agent.

Heretofore, (1) an increase in stability, (2) an increase in plating rate, and (3) an increase in mechanical strength of plating film have been required for these plating solutions. In the electroless copper plating, the plating rate depends mainly upon a complexing agent for cupric ions, and the mechanical strength of plating film depends mainly upon a complexing agent for cuprous ions. Thus, various compounds have been investigated. As the complexing agent for cuprous ions, cyanic compounds, nitrile compounds, nitrogen-containing heterocyclic compounds (phenanthroline and its substituted derivatives and dipyridyl and its substituted derivatives), and sulfur-containing inorganic and organic compounds are now used. As the complexing agent for cupric ions, ethylenediaminetetraacetic acid, hydroxyethylethylenediaminetriacetic acid, diethylenetriaminetriacetic acid, diethylenetriaminetriacetic acid, diethylenetriaminepentaacetic acid, nitriloacetic acid, iminodiacetic acid, cyclohexylenediaminetetraacetic acid, N,N,N',N'-tetrakis(2-hydroxypropyl)ethylenediaminecitric acid, and tartaric acid are now used.

The increase in the stability of the electroless copper plating solution can be attained by use of a stabilizer. As the stabilizer, surfactants such as polyethyleneglycolstearylamine (U.S. Pat. No. 3,804,638), polyethylene oxide, polyethylene glycol, polyether, polyester, etc. are now used. The stabilizer absorbs a substance deteriorating the stability of the plating solution, thereby increasing the stability of the plating solution. However, the stabilizer is also liable to absorption onto the surface of plating film, disturbing deposition of copper and retarding the plating rate. Furthermore, some stabilizer is liable to undergo to decomposition during the plating, forming a blackish or brittle plating film. Thus, development of technique satisfying the plating rate, mechanical strength of plating film, and stability of plating solution at the same time has been in keen demand.

SUMMARY OF THE INVENTION

An object of the present invention is to provide an electroless copper plating solution capable of producing an electroless copper plating film having an improved mechanical strength such as elongation, tensile strength, etc. of the film, as well as improved plating rate and stability of plating solution.

The present inventors have found that the object of the present invention can be attained by using an electroless copper plating solution comprising water, a water-soluble copper salt, a complexing agent for cupric ions, a reducing agent, a pH-controlling agent, and at least one of stabilizers represented by the following general formulae (1)–(4):

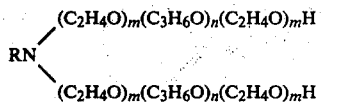

(1)

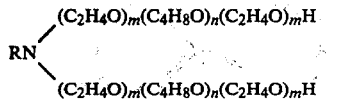

(2)

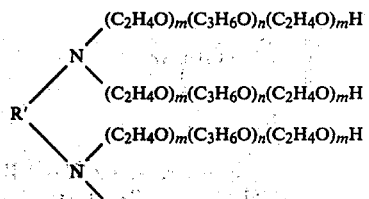

(3)

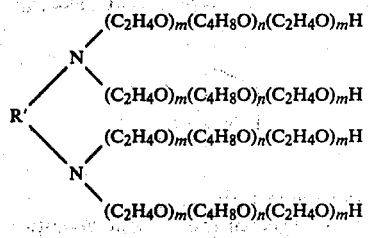

(4)

wherein m and n are integers of 1–100, R represents an alkyl group having 1 to 3 carbon atoms and R' an alkylene group of $-CH_2-$, $-(CH_2)_2-$ or $-(CH_2)_3-$, or an electroless copper plating solution comprising water, a water-soluble copper salt, a reducing agent, a pH-controlling agent, a stabilizer and at least one of complexing agents for cupric ions represented by the following general formulae:

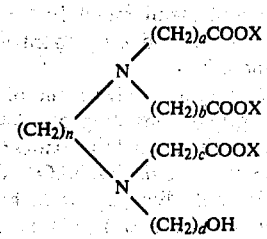

(5)

-continued

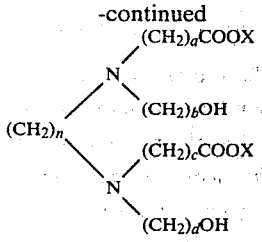

(6)

wherein a, b, c, and d are integers of 1-3, n 2 or 3, and X a hydrogen atom or an alkali metal, or an electroless copper plating solution comprising water, a water-soluble copper salt, a complexing agent for cupric ion, a reducing agent, a pH-comprising agent, and at least one complexing agent for cuprous ions selected from the compounds represented by the following general formulae (7)-(9):

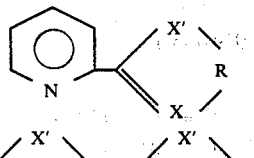

(7)

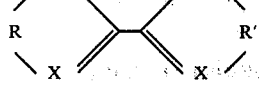

(8)

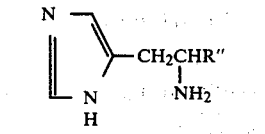

(9)

wherein X is —N—, X' is —NH—, —$CH_2$—, R and R' are —$(CH_2)_2$—, —$(CH_2)_3$—, —CH=CH—, —CH=CH—$CH_2$—, —N=N—, —N=N—$CH_2$—, and

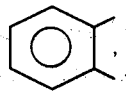

and R'' is a fatty acid residue.

Materials to be used in the present invention will be explained below:

(1) Water-soluble copper salt: at least one of water-soluble copper salts, selected from the group consisting of sulfate, nitrate, acetate, formate, carbonate, and hydroxide of copper is used. Usually, $CuSO_4.5H_2O$ is used. The amount of the water-soluble copper salt to be used is usually 0.015-0.12 mole/l.

(2) Reducing agent: at least one member selected from the group consisting of formaldehyde, paraformaldehyde, glyoxal, trioxane, and other formaldehyde condensation products; alkali metal borohalides and their substituted derivatives; amineboranes and their substituted derivatives; and alkali metal hypophosphites is used. The amount of the reducing agent to be used is usually 0.02-0.5 mole/l.

(3) pH-controlling agent: at least one of compounds selected from the group consisting of alkali metal hydroxides, alkaline earth metal hydroxides, and ammonium hydroxide is used. Usually, NaOH is used. The amount of the pH-controlling agent to be used is an amount necessary enough to make pH 11-13.5.

(4)Stabilizer: at least one of stabilizers selected from the group consisting of compounds represented by the following general formulae (1)-(4):

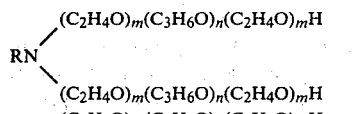

(1)

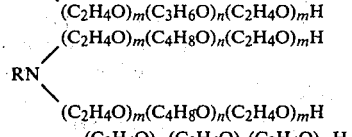

(2)

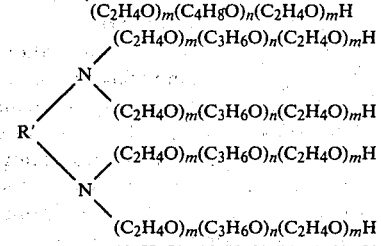

(3)

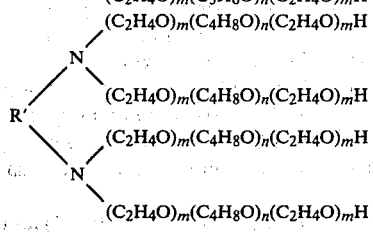

(4)

wherein m and n are integers of 1-100, R an alkyl group of 1 to 3 carbon atoms, and R' an alkylene group of —$CH_2$—, —$(CH_2)_2$— or —$(CH_2)_3$—, is used. The amount of the stabilizer to be used is preferably in a range of $1\times10^{-6}$ to $1\times10^{-4}$ mole/l. Below $1\times10^{-6}$ mole/l, the stabilizer is less effective, whereas aboe $1\times10^{-4}$ mole/l, the mechanical strength of the plating film will be lower.

When the stabilizer is used together with a complexing agent for cupric ions represented by the following general formulae (5) and (6), other stabilizers than those (1) to (4) can be used. Such stabilizers include, for example, polyethyleneglycolstearylamine, polyethyleneglycolmonooleylether, polyethyleneglycol monostearate, etc.

(5) Complexing agent for cupric ions: at least one of complexing agents for cupric ions represented by the following general formulae (5) and (6) is used:

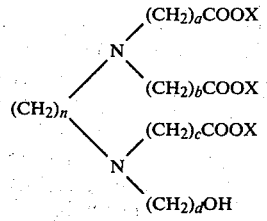

(5)

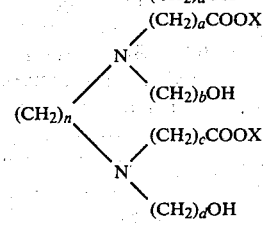

(6)

wherein a, b, c and d are integers of 1 to 3, n 2 or 3; and X a hydrogen atom or alkali metal. The amount of the complexing agent for cupric copper ions to be used is 0.03–0.24 moles/l. Below 0.03 moles/l, the mechanical strength of plating film will be lower, whereas above 0.24 moles/l the plating solution will be unstable. If there is the stabilizer represented by the general formulae (1) to (4) in the plating solution, at least one of the following complexing agent for cupric ions can be used: ethylenediaminetetraacetic acid, hydroxyethylethylenediaminetriacetic acid, diethylenetriaminetriacetic acid, diethylenetriaminepentaacetic acid, nitrosoacetic acid, iminodiacetic acid, cyclohexylenediaminetetraacetic acid, N,N,N',N'-tetrakis(2-hydroxypropyl)ethylenediamine, citric acid, and tartaric acid. The amount of the complexing agent for cupric ions to be used is usually 0.03–0.24 mole/l.

(6) Complexing agent for cuprous ions: at least one complexing agent for cuprous ions selected from compounds represented by the following general formulae (7)–(9):

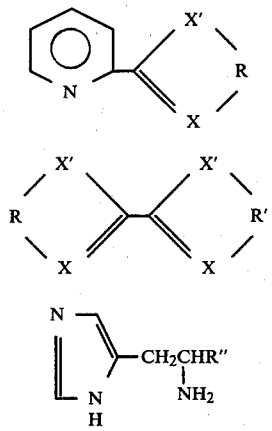

(8)

(9)

wherein X is —N—, X' is —NH—, —$CH_2$—, R and R' are —$(CH_2)_2$—, —$(CH_2)_3$—, —CH=CH—, —CH=CH—$CH_2$—, —N=N—, —N=N—$CH_2$—, and

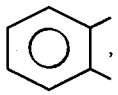

and R'' is a fatty acid residue, is used. Preferable amount of the complexing agent for cuprous ions to be used is $10^{-5}$ to $10^{-3}$ mole/l. Below $10^{-5}$ mole/l the effect is low, whereas above $10^{-3}$ mole/l the plating rate is considerably retarded.

When the complexing agent for cuprous ions is used together with the stabilizer represented by the general formulae (5) and (6) and the complexing agent for cupric ions represented by the general formulae (5) and (6), the following complexing agent for cuprous ions can be used. At least one of compounds selected from the group consisting of alkali metal cyanides, alkaline earth metal cyanides, iron cyanide, cobalt cyanide, nickel cyanide, alkyl cyanide; dipyridyl and its substituted derivatives; phenanthroline and its substituted derivatives; alkali glycol thio-derivatives, S-N bond-containing aliphatic or 5-membered heterocyclic compounds; thioamino acid, alkali sulfides, alkali polysulfides, alkali thiocyanates, alkali sulfites, and alkali thiosulfates is used.

DESCRIPTION OF THE PREFERRED EMBODIMENTS

The present invention will be described in detail below, referring to Examples.

EXAMPLE 1

Before electroless copper plating, test pieces of phenol laminate was subjected to the following pretreatment comprising:

(1) water washing, (2) defatting and water washing, (3) surface cleaning by dipping in a solution consisting of 50 g of chromic anhydride, 500 ml of water and 200 ml of sulfuric acid for 5 minutes, (4) water washing, (5) sensitization by dipping in a solution consisting of 50 g of tin chloride, 100 ml of hydrochloric acid, and 1 l of water for 3 minutes, (6) water washing, (7) activation by dipping in a solution consisting of 0.1 g of palladium chloride and 1 l of water, and (8) water washing.

Then, the pretreated test pieces of phenol laminate were dipped in electroless copper plating solutions having compositions shown in Table 1-1, Nos. 1–6 at a liquid temperature of 70° C. for one hour, where No. 6 is the conventional electroless copper plating solution. Results are shown in Table 1-2, Nos. 1–6. It is seen from the results that the effective amount of the present novel stabilizer (amine compound having at least two polyolefinglycol chains in one molecule) to be used is $1\times10^{-6}$–$1\times10^{4}$ mole/l (Tables 1-1 and 1-2, Nos. 2–4); above or below said range of the effective amount (Tables 1-1 and 1-2, No. 1 and No. 5) the plating solution undergoes decomposition, lowering the tensile strength and elongation of the plating film; the present plating solution is better in stability than the conventional electroless copper plating solution using the conventional stabilizer (Tables 1-1 and 1-2, No. 6) and the resulting plating film are higher in tensile strength and elongation than that obtained from the conventional electroless copper plating solution.

TABLE 1-1

| | Water-soluble copper salt | | Complexing agent for cupric ions | | Reducing agent | | pH-controlling agent | |
|---|---|---|---|---|---|---|---|---|
| No. | Molecular formula | Concentration (mole/l) | Molecular formula | Concentration (mole/l) | Molecular formula | Concentration (mole/l) | Molecular formula | pH |
| 1 | | | | | | | | |
| 2 | | | | | | | | |
| 3 | | | | | | | | |
| 4 | $CuSO_4 . 5H_2O$ | 0.06 | EDTA . 2Na | 0.12 | HCHO | 0.15 | NaOH | 12.5 |
| 5 | | | | | | | | |
| 6 | | | | | | | | |

Complexing agent

TABLE 1-1-continued

| No. | for cuprous ions: Molecular formula | for cuprous ions: Concentration (mole/l) | Stabilizer: Molecular formula | Stabilizer: Concentration (mole/l) | Remark |
|---|---|---|---|---|---|
| 1 | — | — | 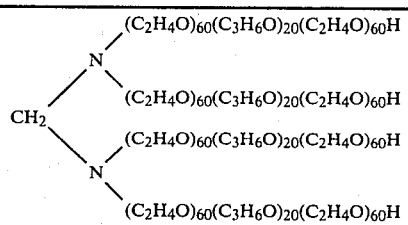 | $1 \times 10^{-7}$ | |
| 2 | | | | $1 \times 10^{-6}$ | |
| 3 | | | | $1 \times 10^{-5}$ | |
| 4 | | | | $1 \times 10^{-4}$ | |
| 5 | | | | $1 \times 10^{-3}$ | |
| 6 | | | Polyethyleneglycol-stearylamine* | $1 \times 10^{-5}$ | Conventional |

*$H(OCH_2CH_2)_{10}NHC_{18}H_{37}$

TABLE 1-2

| No. | Stability of plating solution (continuous plating for 3 hr) | Plating rate (μm/h) | Mechanical property of plating film: Elongation (%) | Mechanical property of plating film: Tensile strength (kg/mm²) | Judgement |
|---|---|---|---|---|---|
| 1 | Unstable (decomposed) | 2.8 | 2.0 | 28 | NG* |
| 2 | Stable (not decomposed) | 3.9 | 2.7 | 29 | OK |
| 3 | Stable (not decomposed) | 4.2 | 2.9 | 30 | OK |
| 4 | Stable (not decomposed) | 4.1 | 2.8 | 27 | OK |
| 5 | Unstable (decomposed) | 3.9 | 1.9 | 29 | NG* |
| 6 | Stable (not decomposed) | 2.0 | 2.0 | 24 | NG* |

*No good.

EXAMPLE 2

Test pieces of phenol laminate pretreated in the same manner as in Example 1 were dipped in electroless copper plating solutions having compositions shown in Table No. 2-1, Nos. 7–12, and subjected to plating under the same conditions as in Example 1, where No. 12 is the conventional electroless copper plating solution. Results are shown in Table 2-2, Nos. 7–12. It is obvious from the results that the present novel stabilizer has the effect similar to that obtained in Example 1, even if there is the complexing agent for cuprous ions, without deteriorating the effect upon the mechanical strength and elongation of the resulting plating film.

TABLE 2-1

| No. | Water-soluble copper salt: Molecular formula | Water-soluble copper salt: Concentration (mole/l) | Complexing agent for cupric ions: Molecular formula | Complexing agent for cupric ions: Concentration (mole/l) | Reducing agent: Molecular formula | Reducing agent: Concentration (mole/l) | pH-controlling agent: Molecular formula | pH-controlling agent: pH |
|---|---|---|---|---|---|---|---|---|
| 7 | | | | | | | | |
| 8 | | | | | | | | |
| 9 | $CuSO_4 . 5H_2O$ | 0.06 | EDTA . 2Na | 0.12 | HCHO | 0.15 | NaOH | 12.5 |
| 10 | | | | | | | | |
| 11 | | | | | | | | |
| 12 | | | | | | | | |

| No. | Complexing agent for cuprous ions: Molecular formula | Complexing agent for cuprous ions: Concentration (mole/l) | Stabilizer: Molecular formula | Stabilizer: Concentration (mole/l) | Remark |
|---|---|---|---|---|---|
| 7 | 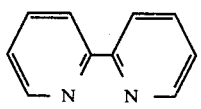 | $6 \times 10^{-5}$ | 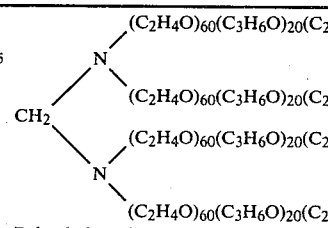 | $1 \times 10^{-7}$ | |
| 8 | | | | $1 \times 10^{-6}$ | |
| 9 | | | | $1 \times 10^{-5}$ | |
| 10 | | | | $1 \times 10^{-4}$ | |
| 11 | | | | $1 \times 10^{-3}$ | |
| 12 | | | Polyethyleneglycol-stearylamine* | $1 \times 10^{-5}$ | Conventional |

*$H(OCH_2CH_2)_{10}NHC_{18}H_{37}$

TABLE 2-2

| No. | Stability of plating solution (continuous plating for 3 hr) | Plating rate (μm/h) | Mechanical property of plating film: Elongation (%) | Mechanical property of plating film: Tensile strength (kg/mm²) | Judgement |
|---|---|---|---|---|---|
| 7 | Unstable (decomposed) | 2.6 | 2.9 | 30 | NG* |
| 8 | Stable (not decomposed) | 4.0 | 3.4 | 32 | OK |
| 9 | Stable | 4.2 | 4.0 | 35 | OK |

TABLE 2-2-continued

| No. | Stability of plating solution (continuous plating for 3 hr) | Plating rate (μm/h) | Mechanical property of plating film: Elongation (%) | Tensile strength (kg/mm²) | Judgement |
|---|---|---|---|---|---|
| | (not decomposed) | | | | |
| 10 | Stable (not decomposed) | 4.1 | 4.2 | 34 | OK |
| 11 | Unstable (decomposed) | 3.9 | 2.8 | 29 | NG* |
| 12 | Stable (not decomposed) | 2.2 | 3.1 | 28 | NG* |

solution containing the conventional complexing agent for cupric ions (Tables 3-1 and 3-2, No. 18) and the resulting film obtained from the present electroless copper plating solution is higher in tensile strength and elongation than the conventional electroless copper plating solution (Tables 3-1 and 3-2, No. 18).

The electroless copper plating solution containing the present novel complexing agent for cupric ions and the conventional stabilizer together (Tables 3-1 and 3-2, No. 18) has a considerably higher plating rate than an electroless copper plating solution containing the conventional complexing agent for cupric ions and the conventional stabilizer together.

TABLE 3-1

| No. | Water-soluble copper salt: Molecular formula | Concentration (mole/l) | Complexing agent for cupric ions: Molecular formula | Concentration (mole/l) | Reducing agent: Molecular formula | Concentration (mole/l) | pH-controlling agent: Molecular formula | pH |
|---|---|---|---|---|---|---|---|---|
| 13 | $CuSO_4 \cdot 5H_2O$ | 0.005 | 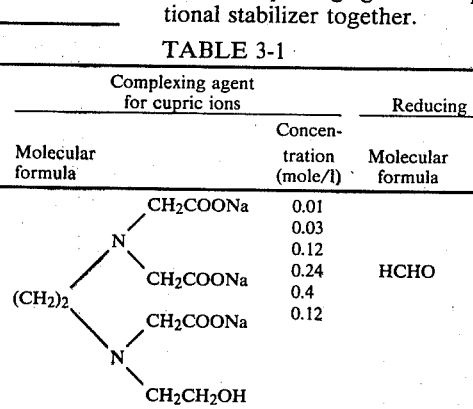 | 0.01 | HCHO | 0.15 | NaOH | 12.5 |
| 14 | | 0.015 | | 0.03 | | | | |
| 15 | | 0.06 | | 0.12 | | | | |
| 16 | | 0.12 | | 0.24 | | | | |
| 17 | | 0.2 | | 0.4 | | | | |
| 18 | | 0.06 | | 0.12 | | | | |
| 19 | | 0.06 | EDTA . 2Na | 0.12 | | | | |

| No. | Complexing agent for cuprous ions: Molecular formula | Concentration (mole/l) | Stabilizer: Molecular formula | Concentration (mole/l) | Remark |
|---|---|---|---|---|---|
| 13 | — | — | 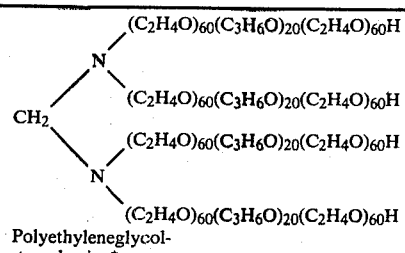 | $1 \times 10^{-5}$ | |
| 14 | | | | | |
| 15 | | | | | |
| 16 | | | | | |
| 17 | | | | | |
| 18 | | | | | |
| 19 | | | Polyethyleneglycol-stearylamine* | | Conventional |

$H(OCH_2CH_2)_{10}NHC_{18}H_{37}$

*No good.

EXAMPLE 3

Test pieces of phenol laminate pretreated in the same manner as in Example 1 were dipped in electroless copper plating solutions having compositions shown in Table 3-1, Nos. 13–18, and subjecting to plating under the same conditions as in Example 1 (No. 19 is the conventional electroless copper plating solution). Results are shown in Table 3-2, Nos. 13–19.

It is obvious from the results that the effective amount of the present novel complexing agent for cupric ions (alkylene diamine, at least one hydrogen atom of the respective amino groups being substituted by $CH_2COOX$ (wherein X is H or Na) and another hydrogen atom being substituted by $CH_2OH$) to be added is 0.03–0.24 mole/l, and the plating solution is decomposed below or above said range of the effective amount (Tables 3-1, and 3-2, No. 13 and No. 17), lowering the tensile strength and elongation of plating film, and the present copper plating solution is better in stability than the conventional electroless copper plating

TABLE 3-2

| No. | Stability of plating solution (continuous plating for 3 hr) | Plating rate (μm/h) | Mechanical property of plating film: Elongation (%) | Tensile strength (kg/mm²) | Judgement |
|---|---|---|---|---|---|
| 13 | Stable (not decomposed) | 1.0 | 2.1 | 29 | NG* |
| 14 | Stable (not decomposed) | 2.9 | 3.5 | 30 | OK |
| 15 | Stable (not decomposed) | 10.5 | 3.9 | 33 | OK |
| 16 | Stable (not decomposed) | 10.1 | 3.7 | 31 | OK |
| 17 | Unstable (decomposed) | 16.3 | 0.9 | 26 | NG* |
| 18 | Stable (not decomposed) | 10.3 | 3.0 | 29 | OK |
| 19 | Stable (not decomposed) | 2.0 | 2.0 | 24 | NG* |

*No good.

EXAMPLE 4

Test pieces pretreated in the same manner as in Example 1 were dipped in electroless copper plating solutions having compositions shown in Table 4-1, Nos. 20–26 and subjected to plating under the same conditions as in Example 1. Results are shown in Table 4-2, Nos. 20–26.

It is obvious from the results that the present novel complexing agent for cupric ions has the effects similar to those of Example 3, even if there is the complexing agent for cuprous ions, without deteriorating the effect upon the mechanical strength and elongation of the plating film.

TABLE 4-1

| | Water-soluble copper salt | | Complexing agent for cupric ions | | Reducing agent | | pH-controlling agent | |
|---|---|---|---|---|---|---|---|---|
| No. | Molecular formula | Concentration (mole/l) | Molecular formula | Concentration (mole/l) | Molecular formula | Concentration (mole/l) | Molecular formula | pH |
| 20 | $CuSO_4 \cdot 5H_2O$ | 0.005 | 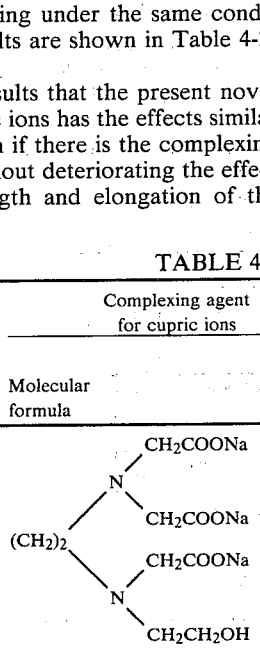 | 0.01 | HCHO | 0.15 | NaOH | 12.5 |
| 21 | | 0.015 | | 0.03 | | | | |
| 22 | | 0.06 | | 0.12 | | | | |
| 23 | | 0.12 | | 0.24 | | | | |
| 24 | | 0.2 | | 0.4 | | | | |
| 25 | | 0.06 | | 0.12 | | | | |
| 26 | | 0.06 | EDTA . 2Na | 0.12 | | | | |

| | Complexing agent for cuprous ions | | Stabilizer | | |
|---|---|---|---|---|---|
| No. | Molecular formula | Concentration (mole/l) | Molecular formula | Concentration (mole/l) | Remark |
| 20 | 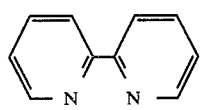 | $6 \times 10^{-5}$ | 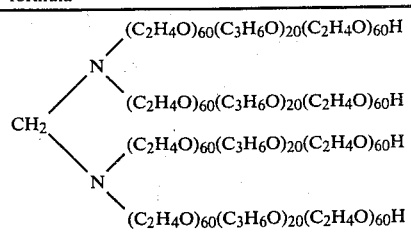 | $1 \times 10^{-5}$ | |
| 21 | | | | | |
| 22 | | | | | |
| 23 | | | | | |
| 24 | | | | | |
| 25 | | | | | |
| 26 | | | Polyethyleneglycol-stearylamine* | $1 \times 10^{-5}$ | Conventional |

*$H(OCH_2CH_2)_{10}NHC_{18}H_{37}$

TABLE 4-2

| No. | Stability of plating solution (continuous plating for 3 hr) | Plating rate (μm/h) | Mechanical property of plating film: Elongation (%) | Mechanical property of plating film: Tensile strength (kg/mm²) | Judgement |
|---|---|---|---|---|---|
| 20 | Stable (not decomposed) | 1.0 | 2.8 | 31 | NG* |
| 21 | Stable (not decomposed) | 2.7 | 4.3 | 41 | OK |
| 22 | Stable (not decomposed) | 9.5 | 4.5 | 40 | OK |
| 23 | Stable (not decomposed) | 9.2 | 4.2 | 40 | OK |
| 24 | Unstable (decomposed) | 15.7 | 1.6 | 29 | NG* |
| 25 | Stable (not decomposed) | 10.7 | 3.5 | 39 | OK |
| 26 | Stable (not decomposed) | 2.2 | 3.1 | 28 | NG* |

TABLE 4-2-continued

| No. | Stability of plating solution (continuous plating for 3 hr) | Plating rate (μm/h) | Mechanical property of plating film: Elongation (%) | Mechanical property of plating film: Tensile strength (kg/mm²) | Judgement |
|---|---|---|---|---|---|
| | (not decomposed) | | | | |

*No good.

EXAMPLE 5

Test pieces of phenol laminate pretreated in the same manner as in Example 1 were dipped in electroless copper plating solutions having compositions shown in Table 5-1, Nos. 27–34 and plated under the same conditions as in Example 1 (No. 34 was the conventional solution). Results are shown in Table 5-2, Nos. 27–34.

It is obvious from the results that the preferable amount of the present complexing agent for cuprous ions (nitrogen-containing cyclic compounds) is $10^{-5}$–$1 \times 10^{-4}$ mole/l (Tables 5-1 and 5-2, Nos. 28–30), and the mechanical strength and elongation of the plating film and the plating rate are lowered below or above said range (Tables 5-1 and 5-2, No. 27, No. 31). Furthermore, it is obvious therefrom that the electroless plating solutions containing the present novel complexing agent for cuprous ions (Tables 5-1 and 5-2, Nos. 27–33) have a higher plating rate and higher tensile strength and elongation of plating film than the electroless copper plating solution containing the conventional complexing agent for cuprous ions (Tables 5-1 and 5-2, No. 34).

TABLE 5-1

| No. | Water-soluble copper salt: Molecular formula | Water-soluble copper salt: Concentration (mole/l) | Complexing agent for cupric ions: Molecular formula | Complexing agent for cupric ions: Concentration (mole/l) | Reducing agent: Molecular formula | Reducing agent: Concentration (mole/l) | pH-controlling agent: Molecular formula | pH-controlling agent: pH |
|---|---|---|---|---|---|---|---|---|
| 27 | | | | | | | | |
| 28 | $CuSO_4 . 5H_2O$ | 0.06 | EDTA . 2Na | 0.12 | NCHO | 0.15 | NaOH | 12.5 |
| 29 | | | | | | | | |
| 30 | | | | | | | | |
| 31 | | | | | | | | |
| 32 | | | | | | | | |
| 33 | | | | | | | | |
| 34 | | | | | | | | |

| No. | Complexing agent for cuprous ions: Molecular formula | Complexing agent for cuprous ions: Concentration (mole/l) | Stabilizer: Molecular formula | Stabilizer: Concentration (mole/l) | Remark |
|---|---|---|---|---|---|
| 27 | 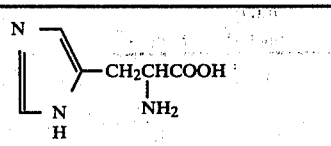 | $10^{-6}$ | Polyethyleneglycol-stearylamine* | $10^{-5}$ | |
| 28 | | $10^{-5}$ | | | |
| 29 | | $10^{-4}$ | | | |
| 30 | | $10^{-3}$ | | | |
| 31 | | $5 \times 10^{-3}$ | | | |
| 32 | 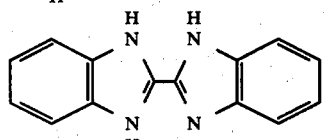 | $10^{-4}$ | | | |
| 33 | 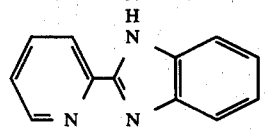 | $10^{-4}$ | | | |
| 34 | 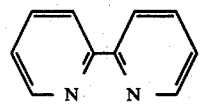 | $6 \times 10^{-5}$ | | | Conventional |

*$H(OCH_2CH_2)_{10}NHC_{18}H_{37}$

TABLE 5-2

| No. | Stability of plating solution (continuous plating for 3 hr) | Plating rate (μm/h) | Mechanical property of plating film: Elongation (%) | Mechanical property of plating film: Tensile strength (kg/mm²) | Judgement |
|---|---|---|---|---|---|
| 27 | Stable (not decomposed) | 2.3 | 2.3 | 30 | NG* |
| 28 | Stable (not decomposed) | 3.2 | 4.5 | 38 | OK |
| 29 | Stable (not decomposed) | 3.7 | 5.0 | 40 | OK |
| 30 | Stable (not decomposed) | 3.0 | 4.9 | 41 | OK |
| 31 | Stable (not decomposed) | 1.4 | 2.5 | 32 | NG* |
| 32 | Stable (not decomposed) | 3.9 | 5.1 | 40 | OK |
| 33 | Stable (not decomposed) | 3.6 | 4.7 | 42 | OK |
| 34 | Stable (not decomposed) | 2.2 | 3.1 | 28 | NG* |

*No good.

EXAMPLE 6

Test pieces of phenol laminate pretreated in the same manner as in Example 1 were dipped in electroless copper plating solutions having compositions shown in Tables 6-1, Nos. 35–38, and plated under the same conditions as in Example 1 (No. 38 was the conventional solution). Results are shown in Table 6-2, Nos. 35–38. It is obvious from the results that the present electroless copper plating solutions containing the novel complexing agent for cupric ions and complexing agent for cuprous ions have a higher plating rate and higher mechanical strength and elongation of the plating film (Table 6-2, Nos. 35–37) than the conventional electroless copper plating solution (Table 6-12, No. 38).

TABLE 6-1

| | Water-soluble copper salt: Molecular | Water-soluble copper salt: Concentration | Complexing agent for cupric ions: Molecular | Complexing agent for cupric ions: Concentration | Reducing agent: Molecular | Reducing agent: Concentration | pH-controlling agent: Molecular |
|---|---|---|---|---|---|---|---|

TABLE 6-1-continued

| No. | formula | (mole/l) | formula | (mole/l) | formula | (mole/l) | formula | pH |
|---|---|---|---|---|---|---|---|---|
| 35 | $CuSO_4 . 5H_2O$ | 0.06 | 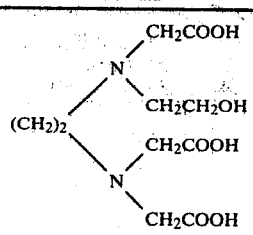 | 0.12 | HCHO | 0.12 | NaOH | 12.5 |
| 36 | | | | | | | | |
| 37 | | | | | | | | |
| 38 | | | EDTA . 2Na | 0.12 | | | | |

| | Complexing agent for cuprous ions | | | | |
|---|---|---|---|---|---|
| No. | Molecular formula | Concentration (mole/l) | Stabilizer Molecular formula | Concentration (mole/l) | Remark |
| 35 | 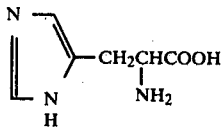 | $10^{-4}$ | Polyethyleneglycol-stearylamine | $10^{-5}$ | |
| 36 | 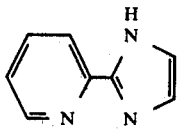 | $10^{-4}$ | | | |
| 37 | 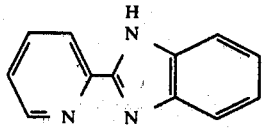 | $10^{-4}$ | Polyethyleneglycol | $10^{-5}$ | |
| 38 | 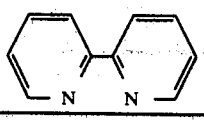 | $6 \times 10^{-4}$ | | | |

TABLE 6-2

| No. | Stability of plating solution (continuous plating for 3 hr) | Plating rate (μm/h) | Mechanical property of plating film: Elongation (%) | Tensile strength ($kg/mm^2$) | Judgement |
|---|---|---|---|---|---|
| 35 | Stable (not decomposed) | 10.2 | 6.0 | 37 | OK |
| 36 | Stable (not decomposed) | 9.5 | 5.5 | 40 | OK |
| 37 | Stable (not decomposed) | 9.6 | 5.2 | 40 | OK |
| 38 | Stable (not decomposed) | 2.2 | 3.1 | 28 | NG* |

*No good.

EXAMPLE 7

Test pieces of phenol laminate pretreated in the same manner as in Example 1 were dipped in electroless copper plating solutions having compositions shown in Table 7-9, Nos. 39–46, and plated under the same conditions as in Example 1 (No. 46 was the conventional solution). Results are shown in Table 7-2, Nos. 39–46.

It is obvious therefrom that the present electroless copper plating solutions containing novel complexing agent for cupric ions, complexing agent for cuprous ions and stabilizer have a considerably higher plating rate and higher mechanical strength and elongation of plating film (Table 7-2, Nos. 39–45) than the conventional electroless copper plating solution (Table 7-2, No. 46).

TABLE 7-1

| | Water-soluble copper salt | | Complexing agent for cupric ions | | Reducing agent | | pH-controlling agent | |
|---|---|---|---|---|---|---|---|---|
| No. | Molecular formula | Concentration (mole/l) | Molecular formula | Concentration (mole/l) | Molecular formula | Concentration (mole/l) | Molecular formula | pH |

TABLE 7-1-continued

| | | | | | | | | |
|---|---|---|---|---|---|---|---|---|
| | $CuSO_4 \cdot 5H_2O$ | 0.06 | 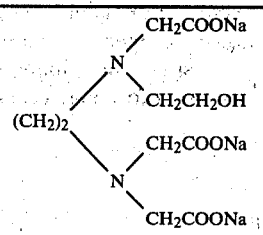 | 0.12 | HCHO | 0.15 | NaOH | 12.5 |
| | | | EDTA . 2Na | 0.12 | | | | |

| No. | Complexing agent for cuprous ions: Molecular formula | Concentration (mole/l) | Stabilizer: Molecular formula | Concentration (mole/l) | Remark |
|---|---|---|---|---|---|
| 39 | 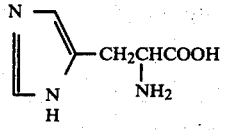 | $10^{-6}$ | 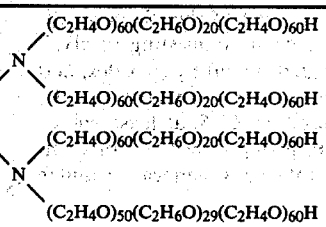 | $1 \times 10^{-5}$ | |
| 40 | | $10^{-5}$ | | | |
| 41 | | $10^{-4}$ | | | |
| 42 | | $10^{-3}$ | | | |
| 43 | | $5 \times 10^{-3}$ | | | |
| 44 | 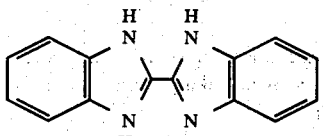 | $10^{-4}$ | | | |
| 45 | 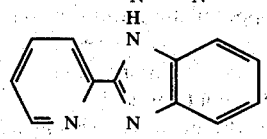 | $10^{-4}$ | | | |
| | 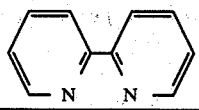 | $6 \times 10^{-5}$ | Polyethyleneglycol-stearylamine | $10^{-5}$ | Conventional |

TABLE 7-2

| No. | Stability of plating solution (continuous plating for 3 hr) | Plating rate (μm/h) | Mechanical property of plating film: Elongation (%) | Tensile strength ($kg/mm^2$) | Judgement |
|---|---|---|---|---|---|
| 39 | Stable (not decomposed) | 11.3 | 4.2 | 35 | OK |
| 40 | Stable (not decomposed) | 10.1 | 5.8 | 41 | OK |
| 41 | Stable (not decomposed) | 9.9 | 7.3 | 43 | OK |
| 42 | Stable (not decomposed) | 6.0 | 6.8 | 40 | OK |
| 43 | Stable (not decomposed) | 3.1 | 6.1 | 28 | NG* |
| 44 | Stable (not decomposed) | 3.8 | 6.0 | 40 | OK |
| 45 | Stable (not decomposed) | 3.7 | 6.2 | 39 | OK |
| 46 | Stable (not decomposed) | 2.2 | 3.1 | 28 | NG* |

*No good.

What is claimed is:

1. In an electroless copper plating solution containing water, a water-soluble copper salt, a complexing agent for cupric ions, a reducing agent, a pH-controlling agent, and a stabilizer, the improvement wherein said plating solution contains at least one of the stabilizers represented by the following general formulae (1)–(4):

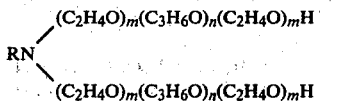

(1)

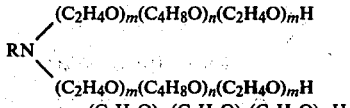

(2)

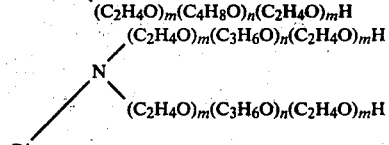

(3)

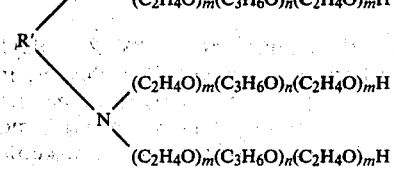

(4)

wherein m and n are integers of 1–100, R an alkyl group having 1 to 3 carbon atoms, and R′ an alkylene group of —$CH_2$—, —$(CH_2)_2$—, or —$(CH_2)_3$—.

2. An electroless copper plating solution, which comprises at least one of the water-soluble copper salts selected from the group consisting of sulfate, nitrate, acetate, formate, carbonate, and hydroxide of copper, at least one of the complexing agents for cupric ions selected from the group consisting of ethylenediaminetetraacetic acid, hydroxyethylethylenediaminetriacetic acid, diethylenetriaminetriacetic acid, diethylenetriaminepentaacetic acid, nitriloacetic acid, iminodiacetic acid, cyclohexylenediaminetetraacetic acid, N,N,N′,N′-tetrakis(2-hydroxypropyl)ethylene diamine, citric acid and tartartic acid; at least one of the reducing agents selected from the group consisting of formaldehyde, paraformaldehyde, glyoxal, and trioxane, and alkali metal hypophosphites; at least one of the pH-controlling agents selected from the group consisting of alkali metal hydroxides, alkaline earth metal hydroxides, and ammonium hydroxide, in an amount necessary to make the pH of the plating solution 11–13.5; at least one of stabilizers selected from the group consisting of compounds represented by the following general formulae (1)–(4):

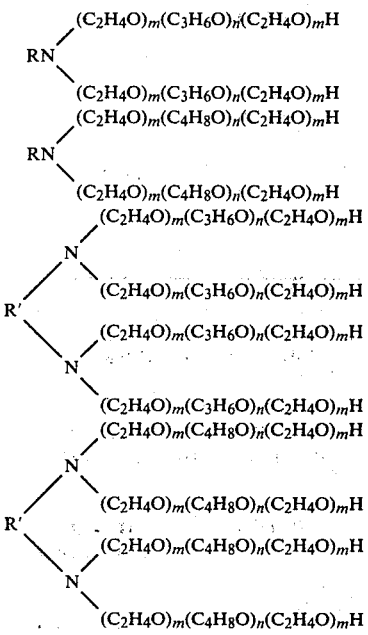

wherein m and n are integers of 1–100, R an alkyl group having 1 to 3 carbon atoms, and R′ an alkylene group of —$CH_2$—, —$(CH_2)_2$—, or —$(CH_2)_3$—in an amount of $1\times10^{-6}$–$1\times10^{-4}$ mole/l, and water in an amount to dissolve the foregoing compounds and make the solution 1 l.

3. An electroless copper plating solution according to claim 1 or 2, wherein a complexing agent for cuprous ions is contained therein.

4. An electroless copper plating solution according to claim 3, wherein the complexing agent for cuprous ion is at least one of the compounds selected from the group consisting of alkali metal cyanides, alkaline earth metal cyanides, iron cyanide, cobalt cyanide, nickel cyanide, dipyridyl, phenanthroline, thioamino acid, alkali metal sulfite, and alkali metal thiosulfate.

5. An electroless copper plating solution according to claim 1 or claim 2, wherein said at least one of the complexing agents for cupric ions is selected from the group consisting of compounds represented by the following general formulae (5) and (6):

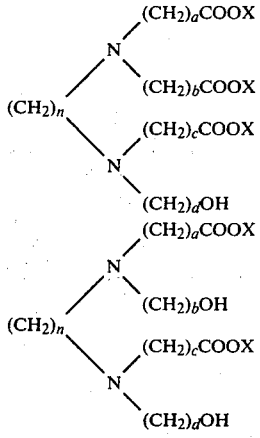

wherein a, b, c and d are integers of 1–3, n is 2 or 3, and X a hydrogen atom or an alkali metal, in an amount of 0.03–0.24 moles/l.

6. In an electroless copper plating solution containing water, a water-soluble copper salt, a reducing agent, and a pH-controlling agent, the improvement wherein said plating solution also contains at least one of the stabilizers selected from the group consisting of compounds represented by the following general formulae (1)–(4):

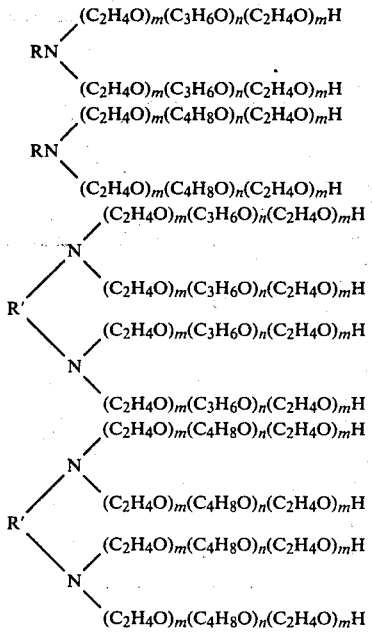

wherein m and n are integers of 1–100, R an alkyl group having 1 to 3 carbon atoms, and R′ an alkylene group of —$CH_2$—, —$(CH_2)_2$— or —$(CH_2)_3$—; at least one of complexing agents for cupric ions selected from compounds represented by the following general formulae (5) and (6):

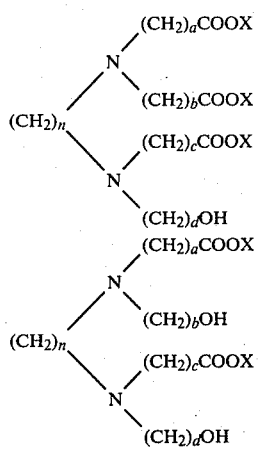

(5)

(6)

wherein a, b, c and d are integers of 1, 2 or 3, n is 2 or 3, and X a hydrogen atom or an alkali metal; and at least one of complexing agents for cuprous ions selected from the group consisting of the compounds represented by the following general formulae (7)–(9):

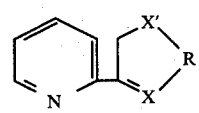

(7)

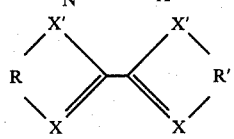

(8)

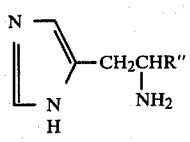

(9)

wherein X is —N—; X′ is —NH—, —$CH_2$—; R, R′ is —$(CH_2)_2$—; —$(CH_2)_3$—, —CH=CH—, —CH=CH—$CH_2$—, —N=N—, —N=N—$CH_2$— and

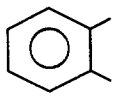

and R″ is a fatty acid residue.

7. An electroless copper plating solution according to claim 6, wherein the pH-controlling agent is contained in an amount necessary to make the pH of the plating solution 11 to 13.5.

8. An electroless copper plating solution according to claim 1, wherein the amount of said at least one stabilizer within said solution is from $1\times10^{-6}$ to $1\times10^{-4}$ mole/l.

9. An electroless copper plating solution according to claim 1, which further contains a complexing agent for cuprous ions represented by the following general formulae (5′)–(7′):

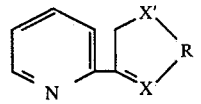

(5′)

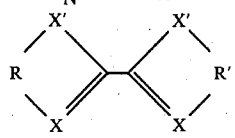

(6′)

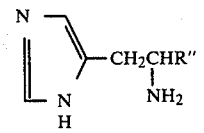

(7′)

wherein X is —N; X′ is —NH—, —$CH_2$—; R, R′ is —$(CH_2)_2$, —$(CH_2)_3$—, —CH=CH—, —CH=CH—$CH_2$—, —N=N—, —N%N—$CH_2$— and

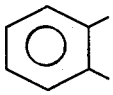

and R″ is a fatty acid residue.

10. An electroless copper plating solution according to claim 1, wherein said stabilizer is

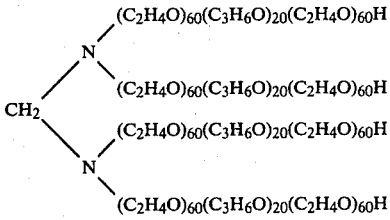

11. An electroless copper plating solution according to claim 9, wherein said stabilizer is

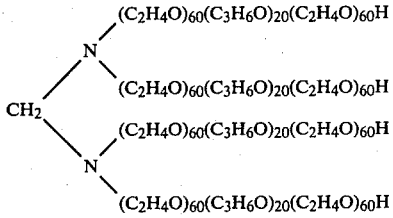

and said complexing agent for cuprous ion is

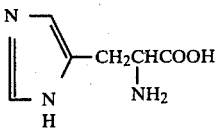

* * * * *

UNITED STATES PATENT AND TRADEMARK OFFICE

CERTIFICATE OF CORRECTION

PATENT NO. : 4,303,443

DATED : December 1, 1981

INVENTOR(S) : Miyazawa et al.

It is certified that error appears in the above—identified patent and that said Letters Patent is hereby corrected as shown below:

On the Title Page, left-hand column:

"[30] Foreign Application Priority Data
Jun. 15, 1979 [JP] Japan ..... 54-74615"

should read:

--[30] Foreign Application Priority Data

Jun. 15, 1979 [JP] Japan ..... 54-74615
Jun. 15, 1979 [JP] Japan ..... 54-74616--

Signed and Sealed this

*Eighteenth* Day of *May 1982*

[SEAL]

*Attest:*

GERALD J. MOSSINGHOFF

*Attesting Officer*

*Commissioner of Patents and Trademarks*